US006084317A

United States Patent [19]

Wolfe et al.

[11] Patent Number: 6,084,317

[45] Date of Patent: Jul. 4, 2000

[54] KEYLESS ACCESS CONTROL SYSTEM WITH WIRELESS, INDUCTION-POWERED KEYPAD MODULE AND METHODS

[75] Inventors: George B. Wolfe, Plymouth; Michael W. Malesko, Ann Arbor, both of Mich.

[73] Assignee: TRW Inc., Lyndhurst, Ohio

[21] Appl. No.: 09/209,095

[22] Filed: Dec. 10, 1998

[51] Int. Cl.[7] ..... H01H 27/10

[52] U.S. Cl. ..... 307/10.4; 307/10.2; 180/287; 340/539; 340/825.34

[58] Field of Search ..... 307/10.1, 10.2, 307/10.4, 104, 17; 340/870.22, 430, 539, 825.69, 825.34; 180/287; 336/DIG. 2

[56] References Cited

U.S. PATENT DOCUMENTS

| | | | |
|---|---|---|---|
| 4,205,325 | 5/1980 | Haygood et al. | 307/10.2 |
| 4,757,212 | 7/1988 | Saito . | |
| 4,835,533 | 5/1989 | Akutsu . | |
| 4,898,010 | 2/1990 | Futami et al. . | |
| 5,041,817 | 8/1991 | Reeb . | |
| 5,497,641 | 3/1996 | Linde et al. . | |
| 5,682,135 | 10/1997 | Labonde | 307/10.2 |
| 5,696,409 | 12/1997 | Handman et al. . | |
| 5,708,307 | 1/1998 | Iijima et al. | 307/10.4 |
| 5,783,994 | 7/1998 | Koopman et al. | 307/10.4 |
| 5,838,074 | 11/1998 | Loeffler et al. | 340/825.34 |
| 5,856,710 | 1/1999 | Baughman et al. | 307/104 |

*Primary Examiner*—Albert W. Paladini
*Attorney, Agent, or Firm*—Tarolli, Sundheim, Covell, Tummino & Szabo L.L.P.

[57] ABSTRACT

A keyless access control system (10) controls access through an entranceway (e.g., a door 16) into a vehicle (12). A sealed security input module (14) of the system (10) is mounted on the vehicle (12) at a location to be accessible by an operator (18) located outside of the vehicle (12). The module (14) includes a keypad (22) manually actuatable by the operator (18) to enter a security code. The module (14) also includes a code-transmitting transmitter (26 and 28). A code-receiving receiver (38 and 40) is located in the vehicle. An induction power coupling (50) connects the security input module (14) and a vehicle power system (58). Preferably, a first half (48) of the induction coupling (50) is located in the module (14), and a second half (52) of the induction coupling is adjacent to the first half (48). During operation, power from the vehicle power system (58) is transferred to the module (14) via the induction coupling (50). The operator (18) manually inputs the security code to the module (14). The code-transmitting transmitter (26 and 28) of the module (14) transmits a RF signal (30) conveying the security code. The code-receiving receiver (38 and 40) receives the signal (30).

21 Claims, 3 Drawing Sheets

KEYLESS ACCESS CONTROL SYSTEM WITH WIRELESS, INDUCTION-POWERED KEYPAD MODULE AND METHODS

FIELD OF THE INVENTION

The present invention relates to a keyless access control system for a vehicle, and specifically, relates to a system that includes a wireless keypad input module.

BACKGROUND OF THE INVENTION

In one known keyless access control system for a vehicle, a keypad input component is mounted on a door of the vehicle. The keypad component includes a plurality of keypad switches that have numeric indicia located thereon. In order for an operator of the vehicle to gain access into the locked vehicle via use of the keypad component, the operator inputs a predefined security code to the keypad component.

The keypad component is "hard-wired" to a vehicle lock controller mechanism and is also hard-wired to a vehicle power supply. In other words, wires or other electrical connectors extend directly into the keypad component. A sealant material is applied to the wiring that extends into the keypad component in an effort to keep moisture and other environmental contaminants out of the keypad component. However, it is possible for moisture and/or other environmental contaminants to migrate along the wires into the keypad component and/or into any connection terminals. Such moisture and/or other environmental contaminants can adversely affect the operation of the keypad component.

SUMMARY OF THE INVENTION

In accordance with one aspect, the present invention provides a keyless access control system for controlling access through an entranceway into a vehicle. A sealed security input module is mounted on the vehicle and is accessible by an operator located outside of the vehicle. The module includes a keypad, which is manually actuatable by the operator to enter a security code, and a code-transmitting transmitter. A code-receiving receiver is located in the vehicle. An induction power coupling is between the security input module and a vehicle power system.

In accordance with another aspect, the present invention provides a keyless access control system that includes security input means, mounted on a vehicle and actuatable by an operator located outside of the vehicle, for input of a security code to cause access to be permitted into the vehicle. The system includes induction coupling means for transferring power from a vehicle power system to the security input means by induction coupling.

In accordance with another aspect, the present invention provides a keyless access control system that includes a security input module that is mounted on a vehicle and that is actuatable by an operator located outside of the vehicle. An induction power coupling of the system is between the security input module and a vehicle power system.

In accordance with yet another aspect, the present invention provides a keyless access control system that includes security input means, mounted on a vehicle and actuatable by an operator located outside of the vehicle, for input of a security code to cause access to be permitted into the vehicle. Access control means, located within the vehicle, controls access in response to the input security code. Radio communication means conveys the input security code from the security input means to the access control means via a RF signal.

In accordance with a still another aspect, the present invention provides a keyless access control system that includes a sealed security input module mounted on a vehicle to be accessible by an operator located outside of the vehicle. The module includes a keypad manually actuatable by the operator to enter a security code, and a code-transmitting transmitter. A code-receiving transmitter is located in the vehicle.

In accordance with yet another aspect, the present invention provides a method of operating a keyless access control system for controlling access through an entranceway into a vehicle. Power is transferred from a vehicle power system to a sealed security input module mounted on the vehicle by an induction coupling pair to power the security input module. The security input module is manually actuated by an operator located outside of the vehicle to input a security code. A RF signal that conveys the security code from the security input means is transmitted. The signal is received at a location in the vehicle.

In accordance with a still further aspect, the present invention provides a method of powering a security input means of an access control system that controls access to an entranceway into a vehicle. The security input means is located on the vehicle for actuation by an operator located outside of the vehicle and is provided with a first half of an induction coupling pair. A second half of the induction coupling pair is provided adjacent to the first half of the induction coupling pair. Power is transferred from a vehicle power system to the security input means by the induction coupling pair to power the security input means.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF PREFERRED EMBODIMENTS

Figure 1:
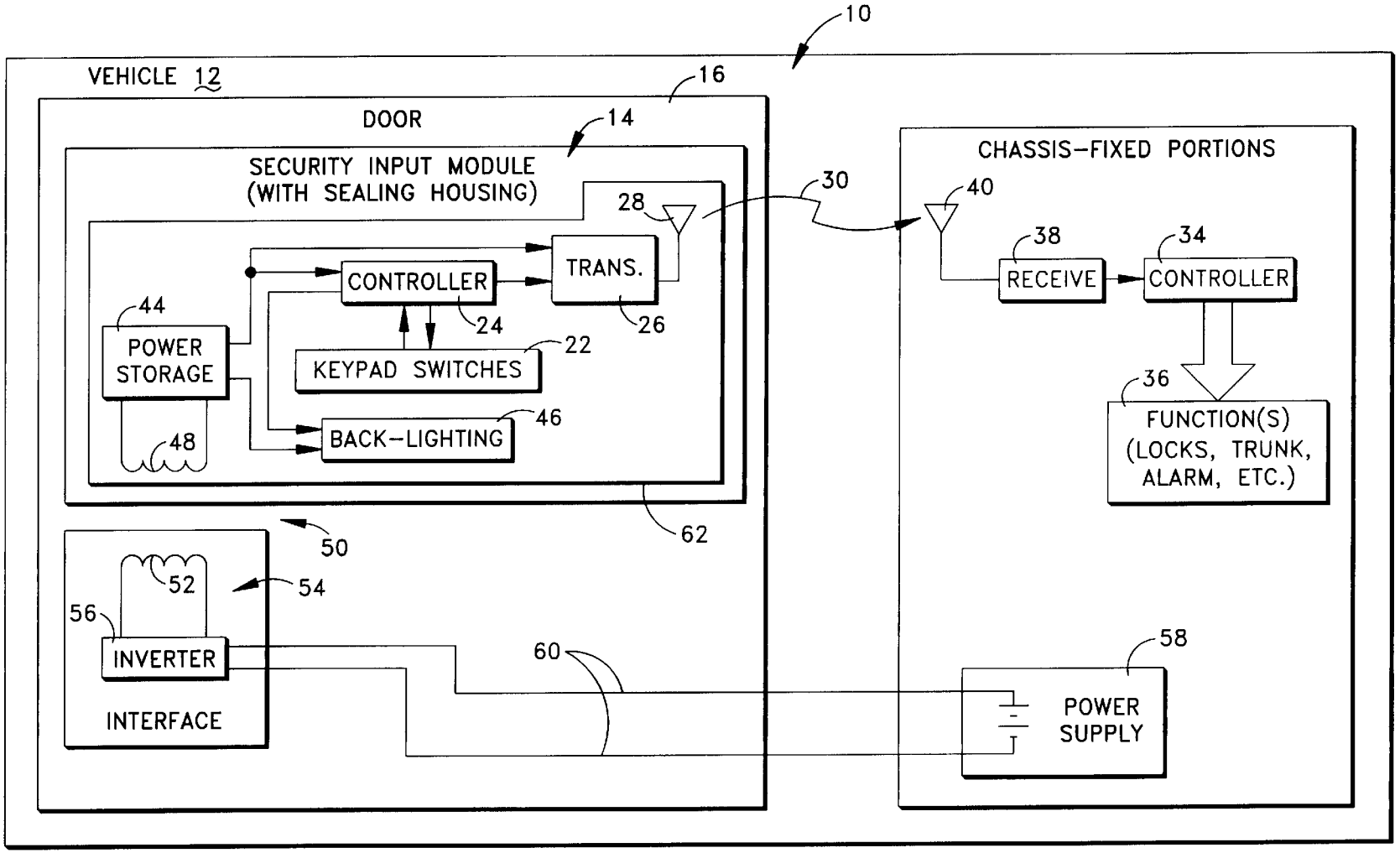
FIG. 1 is a function block diagram of keyless access control system, in accordance with the present invention, in a schematically illustrated vehicle.

A keyless access control system 10 for a vehicle 12 is schematically shown in FIG. 1. The system 10 includes a manually actuatable security input module 14 that is mounted to be exposed on an exterior of the vehicle 12, at/adjacent to an entranceway into the vehicle. In the example shown in FIG. 2, the security input module 14 is mounted on a driver's side door 16 of the vehicle 12. An operator 18 inputs a security code (e.g., a unique sequence of numbers) into the security input module 14 to cause the lock on the driver's side door 16 to be actuated into an unlocked condition to permit the operator to open the door and enter the vehicle 12. It is to be appreciated that the system 10 may be utilized for other entranceways into the vehicle 12, such as a trunk or a hatch of a storage compartment.

The security input module 14 (FIG. 1) includes a plurality of keypad switches 22 (e.g., the single block 22 represents five switches) that are manually actuatable by the operator 18 (FIG. 2) to input the security code. The keypad switches 22 (FIG. 1) are operatively connected to a controller 24 of the security input module 14. The controller 24 deciphers the pattern and/or sequence in which the keypad switches 22 are manually actuated. A RF transmit circuit 26 is operatively connected to the controller 24 and also to an antenna 28.

In response to input of the security code (i.e., via manual switch actuation) at the keypad switches 22, the controller 24 causes the RF transmit circuit 26 to energize the antenna 28 to emit a RF signal 30. The signal 30 conveys the security code.

Within the vehicle 12 (e.g., fixed relative to the chassis and preferably not located within the door 16), is a controller 34 for controlling certain vehicle function(s) 36, such as door locks, truck release, alarm, etc. For the illustrated example, the vehicle function 36 is a door lock mechanism and a lock control circuit. Other vehicle functions 36 may be components for trunk release and/or a vehicle alarm controllable via the security input module 14.

Operatively connected to the controller 34 is a RF receive circuit 38, which is in turn operatively connected to an antenna 40. The signal 30 output from the antenna 28 at the security input module 14 is received at the antenna 40. The antenna 40 outputs an electrical signal to the RF receive circuit 38. The RF received circuit 38 provides a signal to the controller 34 that conveys the security code. It is to be appreciated that, if needed, suitable ciphering, deciphering and other transmission security measures are present.

In response to reception of the appropriate security code, the controller 34 causes actuation of the proper function. Specifically, the controller 34 controls the lock control circuit to causes the driver's side door lock mechanism to actuate to the unlock position.

The conveyance of the security code from the security input module 14 to the controller 34 is via a "wireless" arrangement. In other words, there are no direct wires extending between the security input module 14 and the controller 34 for conveyance of the input security code. The conveyance is via the transmitted signal 30 (i.e., radio communication).

Turning again to the security input module 14, the security input module includes a power storage component 44 that is operatively connected to supply power to components of the security input module. Specifically, the power storage component 44 powers the controller 24 and the RF transmit circuit 26 (i.e., components involved in the conveyance of the security code). The power storage component 44 may also supply power for other components within the security input module 14. In the illustrated example, a back-lighting arrangement 46 is provided for the keypad switches 22 such that the keypad switches 22 are illuminated or glow to aid in actuation of the keypad switches during dim environmental lighting conditions.

The power storage component 44 is operatively coupled to a first half 48 of an induction coupling 50. Specifically, the first half 48 of the induction coupling 50 is a first induction coil (See FIG. 4). A second half 52 (FIG. 1) of the induction coupling 50 is a second induction coil (see FIG. 4). It is to understood that the use of the designations "first" and "second" to identify the coils 48, 52 in the description of the disclosed embodiment is for identification only, and that the designations could be switched without modification of the structure.

The second coil 52 is located adjacent to the first coil 48. However, the second coil 52 is not located within the confines of the security input module 14, per se. The second coil 52 is located within an interface module 54 that is located adjacent to the security input module 14. Within the interface module, the second coil is operatively connected to an inverter 56. In turn, the inverter 56 is connected to an electrical power supply 58 (e.g., a vehicle battery) of the vehicle 12, via wires 60.

When electrical energy is provided to the second coil 52 via the inverter 56, an electric field is generated about the second coil and an electrical current is induced in the first coil 48. The electrical current in the first coil 48 is provided to the power storage component 44 for storage of energy therein. Accordingly, the supply of power into the security input module 14 is "wireless" (in other words, power supply wire(s), such as the wires 60, do not extend into the security input module 14, per se).

Focusing yet again upon the security input module 14, the module includes a sealing housing 62 that encloses the electrical components of the security input module. Specifically, the components sealed within the housing 62 include the controller 24, the RF transmit circuit 26, the antenna 28, the keypad switches 22, the back-lighting arrangement 46, and the power storage component 44. In one embodiment, the housing 62 includes a plastic material.

Sealing these components within the housing 62 prevents moisture and other environment contaminants from reaching these components. Accordingly, these components are protected from the corrupting influence of moisture and other such environmental agents. Although wires 60 run from the power supply 58 into the door 16, the wires do not extend through the sealing housing 62. Thus, moisture and other corrupting environmental agents can not migrate into the sealing housing 62 along a wire connection.

Figures 2, 3:
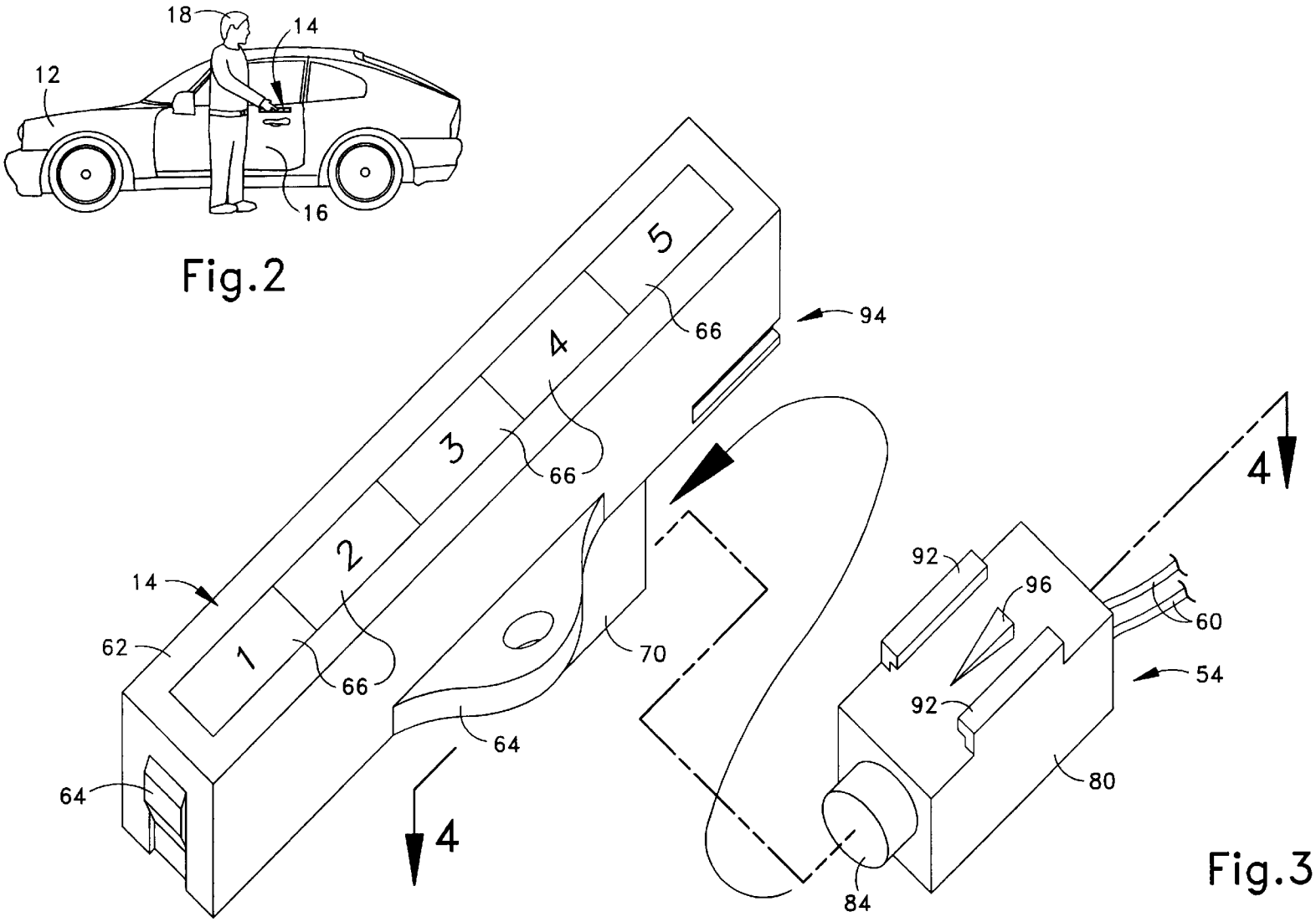
FIG. 2 is a pictorial illustration of the vehicle, showing placement of a security input module of the system of FIG. 1, and an operator.
FIG. 3 is a perspective view of the security input module and an interface module, in an uncoupled state.

The illustration of FIG. 3 shows a preferred mechanical embodiment of the present invention. Mounting portions 64 (only two shown) are provided on the housing 62 for mounting the security input module 14 on the vehicle door 16 (FIG. 2). Typically, the mounting location of the security input module 14 is on or near the location of the vehicle entrance (e.g., the vehicle door 16), and the module is position such that the module is easily accessed by the operator 18 (e.g., adjacent to a door handle).

The keypad switches 22 (not visible in FIG. 3) are covered by flexible, weather-tight material (e.g., rubber) of the housing 62 that define touch pad portions 66. Switch-identification indicia (e.g., numerals "1"–"5") are provided on the material at each touch pad portion 66. When the operator 18 (FIG. 2) manually presses on the switch-covering material at the location of one of the identifying indicia, the corresponding keypad switch 22 is actuated.

A projection 70 of the housing 62 holds the first coil 48 (not visible in FIG. 3). Specifically, in the illustrated embodiment, the first coil 48 (FIG. 4) is located within a cylindrical blind bore 72 that extends into the projection 70. The first coil 48 is cylindrical, with an axially extending through-bore.

A plastic, cup-like retainer 74 and a plastic, disk-shaped washer retainer 76 of the housing 62 hold the first coil 48 within the bore 72. Adhesive is used to hold the first coil 48 and the retainers 74 and 76 in proper position. It is to be noted that as an alternative to the retainers 74 and 76, the first coil may be embedded into the plastic material defining a body of the housing 62.

A housing 80 of the interface module 54 preferably includes a plastic material. The housing 80 is shaped and sized to mate with the housing 62 of the security input module 14, such that the first and second coils 48 and 52 are in close proximity and the interface module remains connected to the security input module. Specifically, a recess in the housing 80 is defined by a wall 82 located at one end of the housing. A cylindrical projection 84 extends out from the recess and away from the housing 80.

The second coil 52 is similar in shape and size (e.g., cylindrical with a through bore) to that of the first coil. The second coil 52 is located within the recess defined by the wall 82 and extends about a base of the projection 84.

A plastic, sleeve-like retainer 86 and a plastic, disk-shaped washer retainer 88 hold the second coil 52. Adhesive is used to hold the second coil 52, and the retainers 86 and 88 in proper position. It is to be noted that as an alternative to the retainers 86 and 88, the second coil 52 may be embedded into the material of a body of the housing 80.

Figure 4:
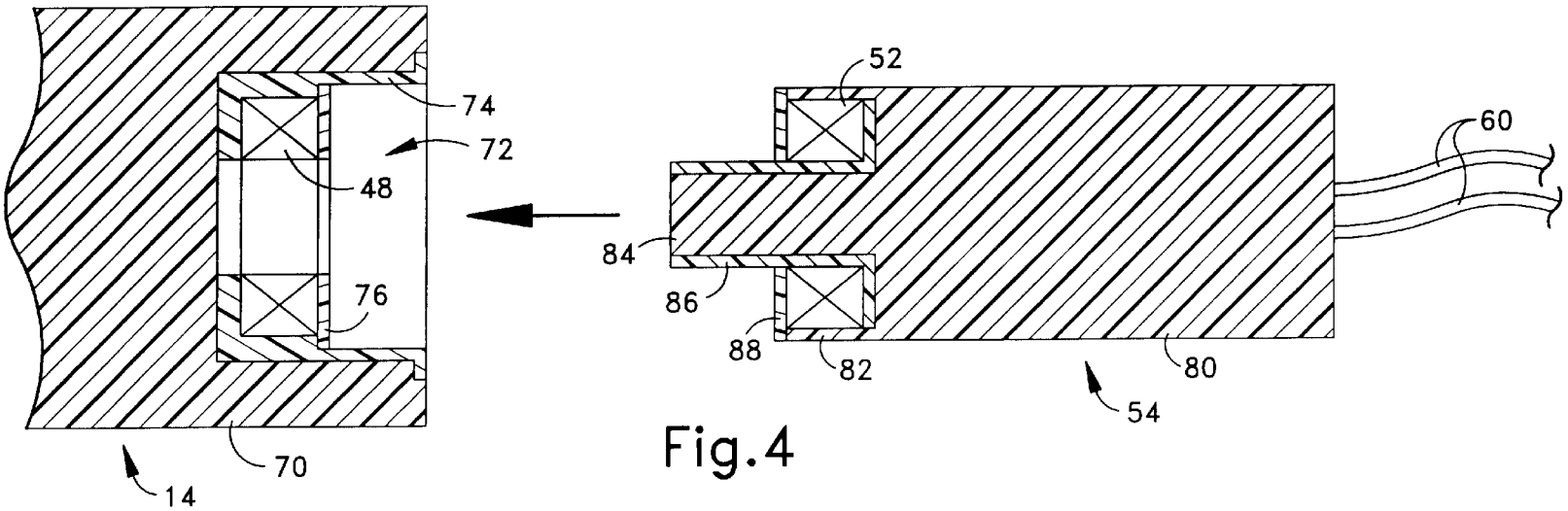
FIG. 4 is a section view taken along line 4—4 of FIG. 3, and shows a portion of the security input module and the interface module in the uncoupled state.
Figure 5:
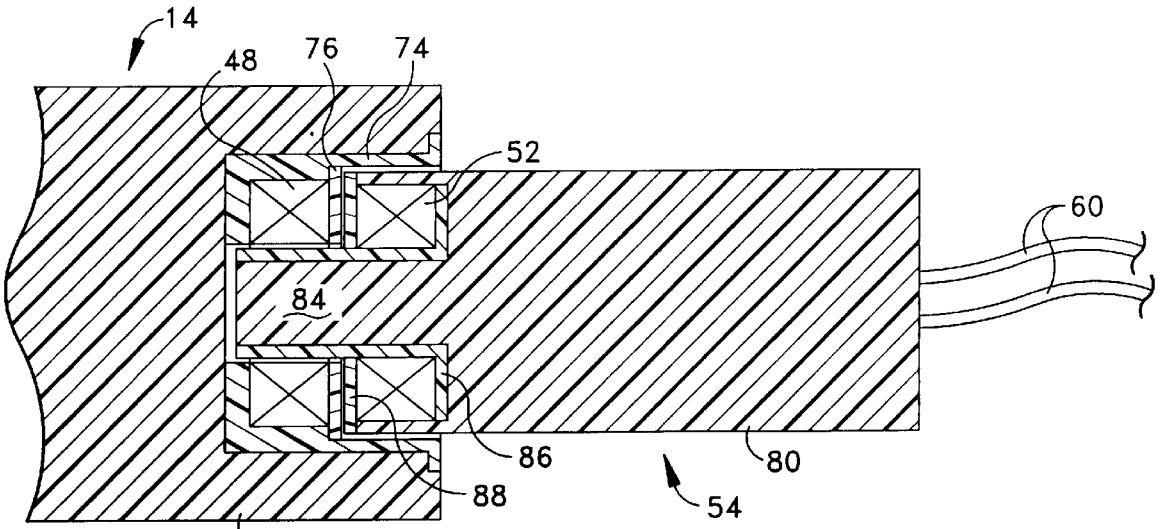
FIG. 5 is a view similar to FIG. 4, but with the security input module and the interface module in a coupled state.

As shown in FIGS. 4 and 5, as the housing 80 of the interface module 54 is moved in a mating motion (identified via arrowheads in FIGS. 3 and 4) toward engagement with the housing 62 of the security input module 14, the projection 84 extends through the first coil 48. Upon mating of the two housings 62 and 80, the two coils 48 and 52 are in close proximity to each other (FIG. 5).

An arrangement that includes two tongues 92 (FIG. 3) on the housing 80 of the interface module 54 and two grooves 94 (only one shown) on the housing 62 of the security input module 14 guides the mating stroke. Specifically, a tongue 92 slides along each groove 94. The tongue and groove arrangement, along with a snap-lock arrangement, holds the housing 80 of the interface module 54 in mating engagement with the housing 62 of the security input module 14. Specifically, in the snap-lock arrangement, a projection 96 of the snap-lock arrangement is located on the housing 80 such that the projection will snap-lock into a detent (not visible) on the housing 62 at the end of the matting stroke.

From the above description of the invention, those skilled in the art will perceive improvements, changes and modifications. Such improvements, changes and modifications within the skill of the art are intended to be covered by the appended claims.

Having described the invention, the following is claimed:

1. A keyless access control system for controlling access through an entranceway into a vehicle, said system comprising:

a sealed security input module mounted on the vehicle to be accessible by an operator located outside of the vehicle, said module including a keypad manually actuatable by the operator to enter a security code and a code-transmitting transmitter;

a code-receiving receiver located in the vehicle; and an induction power coupling between the security input module and a vehicle power system.

2. A system as set forth in claim 1, wherein said module includes a housing, said induction coupling includes a first induction coil located inside said housing and a second coil located outside said housing.

3. A system as set forth in claim 2, including a power storage component operatively connected to said first coil and located within said housing.

4. A system as set forth in claim 1, the entranceway into the vehicle is via a vehicle door, said system includes a controller operatively connected to said receiver, a door lock mechanism and a lock control circuit operatively connected to said controller.

5. A keyless access control system for controlling access through an entranceway into a vehicle, said system comprising:

security input means, mounted on the vehicle and actuatable by an operator located outside of the vehicle, for input of a security code to cause access to be permitted into the vehicle; and induction coupling means for transferring power from a vehicle power system to said security input means by induction coupling.

6. A system as set forth in claim 5, wherein said security input means includes touch pad means, manually actuatable by the operator, for input of the security code.

7. A system as set forth in claim 5, including transmit means, associated with said security input means for transmitting a signal that conveys the security code, receive means, located on the vehicle at a location remote from said transmit means, for receiving the transmitted signal, and control means operatively coupled to said receive means for causing performance of an access-permitting function at the vehicle.

8. A system as set forth in claim 7, wherein said security input means and said transmit means are part of an input module that includes housing means for enclosing components and sealing out adverse environmental elements.

9. A system as set forth in claim 8, wherein said induction coupling means includes first and second induction coils, said first coil is located outside of said housing means and said second coil is enclosed within said housing means.

10. A system as set forth in claim 8, wherein said transmit means includes RF transmit circuitry and an antenna enclosed within said housing means.

11. A system as set forth in claim 5, including power storage and supply means operatively connected to said induction coupling means for storing power transferred from said induction coupling means and for supplying power to electrical components of said security input means.

12. A keyless access control system for controlling access through an entranceway into a vehicle, said system comprising:

a security input module mounted on the vehicle and actuatable by an operator located outside of the vehicle; and an induction power coupling between the security input module and a vehicle power system.

13. A keyless access control system for controlling access through an entranceway into a vehicle, said system comprising:

security input means, mounted on the vehicle and actuatable by an operator located outside of the vehicle, for input of a security code to cause access to be permitted into the vehicle;

access control means, located within the vehicle, for controlling access in response to the input security code; and radio communication means for conveying the input security code from said security input means to said access control means via a RF signal.

14. A system as set forth in claim 13, including induction coupling means for transferring power from a vehicle power system to said security input means by induction coupling.

15. A keyless access control system for controlling access through an entranceway into a vehicle, said system comprising:

a sealed security input module mounted on the vehicle to be accessible by an operator located outside of the vehicle, said module including a keypad manually actuatable by the operator to enter a security code and a code-transmitting transmitter; and a code-receiving receiver located in the vehicle.

16. A system as set forth in claim 15, wherein said module includes a housing, said system includes an induction power coupling between the security input module and a vehicle power system that transfers electromagnetic energy through said housing.

17. A method of operating a keyless access control system for controlling access through an entranceway into a vehicle, said method comprising:

transferring power from a vehicle power system to a sealed security input module mounted on the vehicle by an induction coupling pair to power the security input module;

manually actuating the security input module by an operator located outside of the vehicle to input a security code;

transmitting an RF signal conveying the security code from the security input module; and receiving the signal at a location in the vehicle.

18. A method as set forth in claim 17, including controlling a door lock mechanism to unlock a door of the vehicle in response to receiving the signal.

19. A method of powering a security input means of an access control system that controls access through an entranceway into a vehicle, said system comprising:

providing the security input means, that is located on the vehicle for actuation by an operator located outside of the vehicle, with a first half of an induction coupling pair;

providing a second half of the induction coupling pair adjacent to the first half of the induction coupling pair; and transferring power from a vehicle power system to the security input means by the induction coupling pair to power the security input means.

20. A method as set forth in claim 19, including storing power in a power storage and supply means that is operatively connected to the first half of the induction coupling pair and supplying power from the power storage and supply means to electrical components of said security input means within housing means that encloses components of the security input means.

21. A method as set forth in claim 19, wherein said step of transferring power includes transferring power through the housing means via induction coupling.

* * * * *